United States Patent [19]

Vanhoutte et al.

[11] Patent Number: 4,801,139

[45] Date of Patent: Jan. 31, 1989

[54] COLLAPSIBLE, PORTABLE, EXERCISE MACHINE WITH LOAD-REGULATING HYDRAULIC JACK

[76] Inventors: Henri Vanhoutte; Danièle Masson, both of 52 Chemin des Chênes, Ste-Anne des Lacs, Québec, Canada, J0R 1B0

[21] Appl. No.: 76,705

[22] Filed: Jul. 23, 1987

[30] Foreign Application Priority Data

Oct. 23, 1986 [CA] Canada ..... 521250

[51] Int. Cl.[4] ..... A63B 21/00

[52] U.S. Cl. ..... 272/130; 272/134

[58] Field of Search ..... 272/93, 130–134, 272/136, 142, 144; D12/156, 157

[56] References Cited

U.S. PATENT DOCUMENTS

| | | | |
|---|---|---|---|
| 3,664,666 | 5/1972 | Lloyd | 272/134 |
| 3,741,538 | 6/1973 | Lewis et al. | 272/133 X |
| 4,136,868 | 1/1979 | Hogue | 272/144 |
| 4,275,882 | 6/1981 | Grosser et al. | 272/130 X |
| 4,291,787 | 9/1981 | Brentham | 272/134 X |
| 4,300,761 | 11/1981 | Howard | 272/134 |
| 4,429,871 | 2/1984 | Flechner | 272/130 |
| 4,465,274 | 8/1984 | Davenport | 272/130 |
| 4,618,144 | 10/1986 | Gibson | 272/134 |
| 4,641,833 | 2/1987 | Trethewey | 272/130 X |
| 4,651,986 | 3/1987 | Wang | 272/130 |
| 4,667,955 | 5/1987 | Giesch | 272/130 |

FOREIGN PATENT DOCUMENTS

| | | | |
|---|---|---|---|
| 2554195 | 5/1985 | France | 272/130 |
| 2576651 | 8/1986 | France | 272/130 |

*Primary Examiner*—Richard J. Apley
*Assistant Examiner*—Robert W. Bahr
*Attorney, Agent, or Firm*—Ralph W. Selitto, Jr.

[57] ABSTRACT

The invention is a collapsible exercise machine that is transportable in a container and includes a load-regulating hydraulic cylinder. The machine according to the invention is characterized in that it comprises a frame having a column formed of elements that can be folded onto a base for carriage and two detachable legs arranged on opposite sides of the frame and on which are adjustably mounted two benches for accommodating a user, one of the foldable elements being formed of a housing containing a translation system and the load-regulating hydraulic cylinder. The hydraulic cylinder comprises a piston provided with a rod connected by a first bar to sliding rods themselves connected to a second bar on which is wound via a case a strap connected by transmission members to exercise members actuated by the user. The exercise machine according to the invention can be easily collapsed and transported, especially in a container the shape of which closely matches that of the exercise machine in its collapsed position and that best approximates the aerodynamic characteristics necessary for carriage on all automobile roof racks.

15 Claims, 6 Drawing Sheets

COLLAPSIBLE, PORTABLE, EXERCISE MACHINE WITH LOAD-REGULATING HYDRAULIC JACK

BACKGROUND OF THE INVENTION

The present invention is concerned with an exercise machine which is collapsible and portable, and which includes a hydraulic cylinder regulating load, pull or thrust.

There are various collapsible, portable machines, especially for muscle-building, physical training, physical fitness and rehabilitation , which have means of developing a load resisting any movement by the user in such a manner that the user has to overcome a force to execute said movement.

For this purpose such machines employ weights or spring-loaded mechanisms that have many disadvantages, such as bulkiness, weight that renders carriage difficult and problems with adjusting the force resisting the movements of the user.

There are also collapsible, portable machines in which weights and spring-loaded mechanisms are replaced by hydraulic or pneumatic cylinders that develop a load resisting any movement by the user. However, such machines allow only a very limited number of movements and the cylinders do not provide the precision of fluid or gas flow necessary to regulate the muscle exertion of the user. Furthermore, their mechanical characteristic limits maximum load capabilities.

SUMMARY OF THE INVENTION

It is an object of the present invention to overcome the above disadvantages and to provide a collapsible, portable exercise machine which poses no problems of disassembly and the size of which is not encumbering.

It is a further object of the invention to provide an exercise machine equipped with a load-regulating hydraulic cylinder mathematical precision and without limitations as to the muscle exertion of the user, while at the same time permitting all the basic movements of the human body.

The collapsible, portable exercise machine according to the invention, including a load-regulating hydraulic cylinder, is characterized in that it comprises a frame having a column formed of elements foldable onto a base for carriage and two detachable legs arranged on opposite sides of the frame and on which are adjustably mounted two benches for accommodating a user, one of the foldable elements being formed of a housing containing a translation system and the load-regulating hydraulic cylinder. The hydraulic cylinder comprises a piston provided with a rod connected by a first bar to sliding rods themselves connected to a second bar on which is wound via a case a strap connected by transmission members to exercise members actuated by the user.

The present invention is also directed to a hydraulic cylinder mechanism for regulating load, pull or thrust, characterized in that it comprises a double-walled cylindrical body having a cylindrical inner sleeve within which moves a piston provided with a rod connected to actuating means, the sleeve having ports formed at opposite extremities and allowing communication of an internal space defined in the sleeve with an annular space delimited between the sleeve and the cylindrical body, one of the ports opposite the piston rod being provided with a sealing member controlling the port section to allow the flow of hydraulic fluid into the annular space, the piston being provided with at least one duct opening onto opposite faces of the piston and capable of being closed on one face by a valve during displacement of the piston in one direction of its stroke. The flow port opposite the piston rod comprises at least one longitudinally extending slot formed in a seat fixed to the sleeve, the seat having a bore in which is slidably mounted the sealing member which is integral with a rod threadably engaged in a hole formed in the cylinder body, the rod comprising at its extremity opposite the sealing member a control knob defining a vernier moving opposite a graduated stationary part along an extension of the cylinder body.

The exercise machine according to the invention can be easily collapsed and transported, especially in a container the shape of which closely matches that of the exercise machine in its collapsed position and that best approximates the aerodynamic characteristics necessary for carriage on all automobile roof racks. In a preferred embodiment, the container is shaped like a spacecraft.

BRIEF DESCRIPTION OF THE DRAWINGS

Further features and advantages of the invention will become more readily apparent from the following description of preferred embodiments as illustrated by way of example in the accompanying drawings, in which:

In FIG. 1, there is represented an exercise machine comprising a base 1 resting on the floor by means of two adjustable feet 2 and 3. On one side of this base is hinge-mounted about hinge pin 4 a first column 5 of appropriate height.

Figure 2:
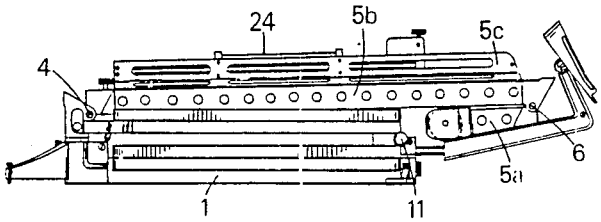
FIG. 2 is a side view of the exercise machine in its collapsed position.

Column 5 is formed of elements **5*a*,5*b* which are themselves foldable about hinge pin 6 so as to fold column 5 onto base 1 to collapse the machine for carriage, as shown in FIG. 2. Element 5*b* is itself formed of housing 5*c*** containing the translation system and the hydraulic cylinder.

Mounted between column 5 and detachable legs 7,7*a* so as to be adjustable in height along column 5 by means of holding pin 8 are two benches 9,9*a* fastened to two tubular frames 10,10*a* and hinged in a semi-circle around threaded, detachable hinge pins 11,11*a* whereby the benches can be positioned end to end to make a convertible abdominal board. Detachable accessory member 12 allows the user to hold on with either his feet or his hands. These benches are intended to accommodate the user in various positions.

Furthermore, the detachable legs 7,7*a* are provided with two arms 13,13*a* mounted for pivotal movement about two hinges 14,14*a* and both comprising oblong apertures 15,15*a*, the arms being interconnected by crossbar 16 that can be blocked at any point along the length of the apertures so as to allow the user to operate the machine with either his arms or his legs, regardless of his morphology. The extent of pivotal movement of arms 13,13*a* depends on whether threaded hinge pin 17 is placed or removed from below hinge 14 of leg 7.

Component 18 which is attached to foot 3 and comprises a groove in its upper part is adapted to receive detachable arm 19 which is adjustable to the morphology of the user and comprises accessory member 20 actuatable with the feet, and column 5 comprises accessory member 21 adjustable in height by means of two holding pins 22,22*a* and intended to be moved upwardly or downwardly with the hands.

Figure 1:
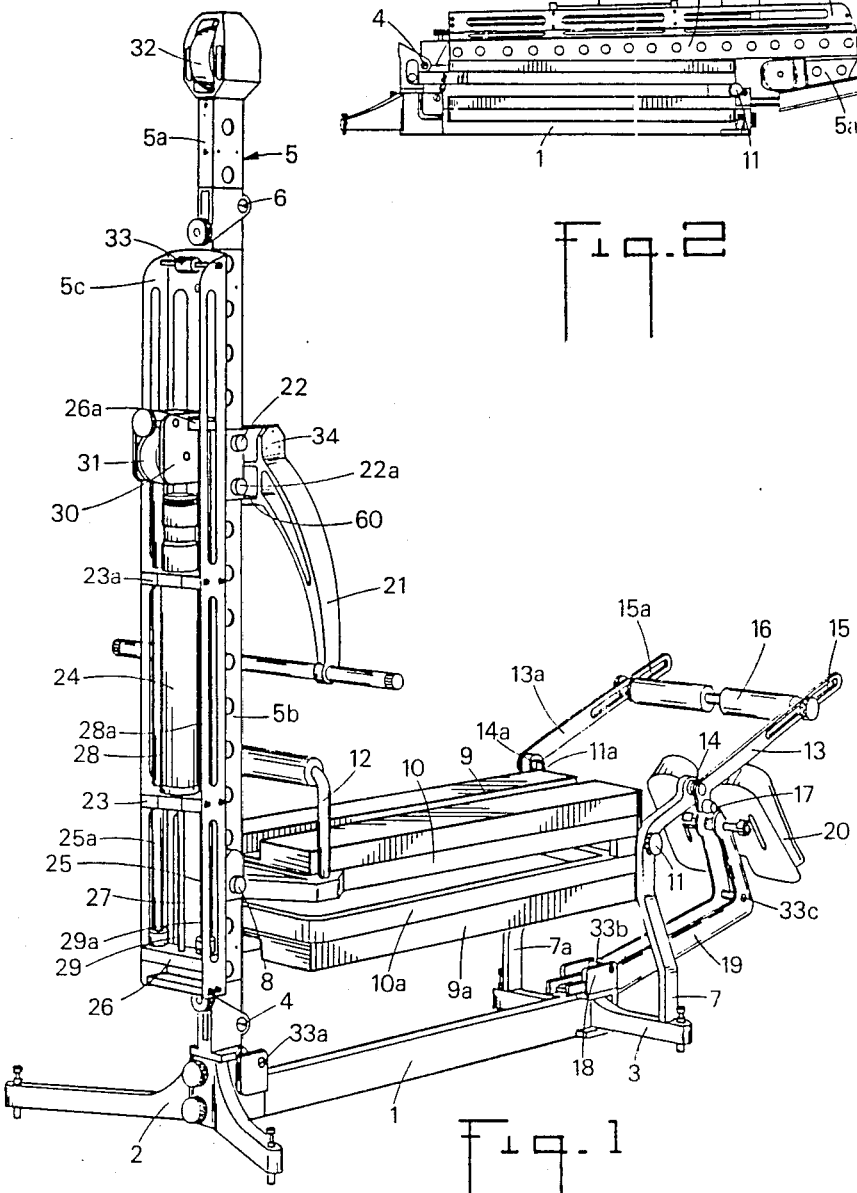
FIG. 1 is a perspective view of an exercise machine comprising a load-regulating hydraulic cylinder, according to the invention.
Figure 3:
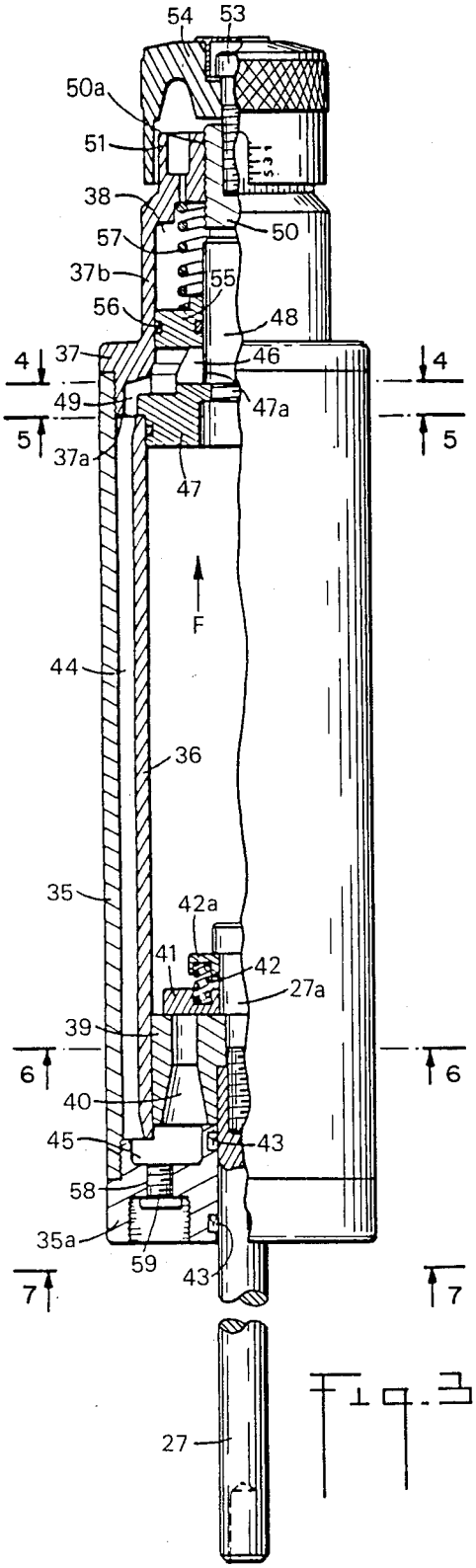
FIG. 3 is a longitudinal section view of the hydraulic cylinder used in the exercise machine.
Figure 4:
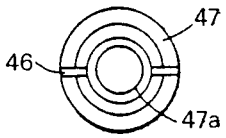
FIG. 4 is a sectional view taken along line 4—4 of FIG. 3.
Figure 5:
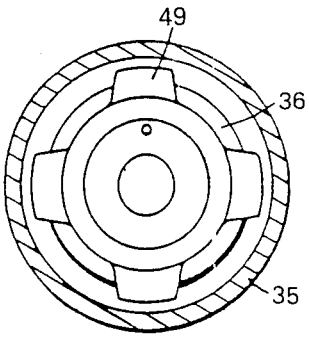
FIG. 5 is a sectional view taken along line 5—5 of FIG. 3.
Figure 6:
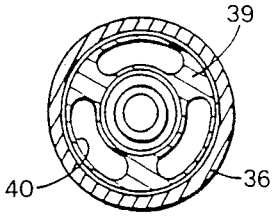
FIG. 6 is a sectional view taken along line 6—6 of FIG. 3.
Figure 7:
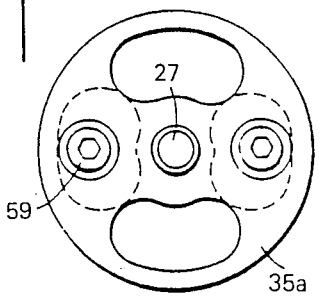
FIG. 7 is a sectional view taken along line 7—7 of FIG. 3.

Two crossbars 23,23*a* attached to housing 5*c* (FIGS. 1,, 8, 9 and 10) block the body of a hydraulic cylinder 24 identical to the one shown in FIG. 3. Between the two crossbars 23,23*a* slide two rods 25,25*a* interconnected by two bars 26,26*a*.

Hydraulic cylinder 24 comprises a piston rod 27 as shown in FIG. 3, the extremity of which is fixed to lower bar 26.

Figure 8:
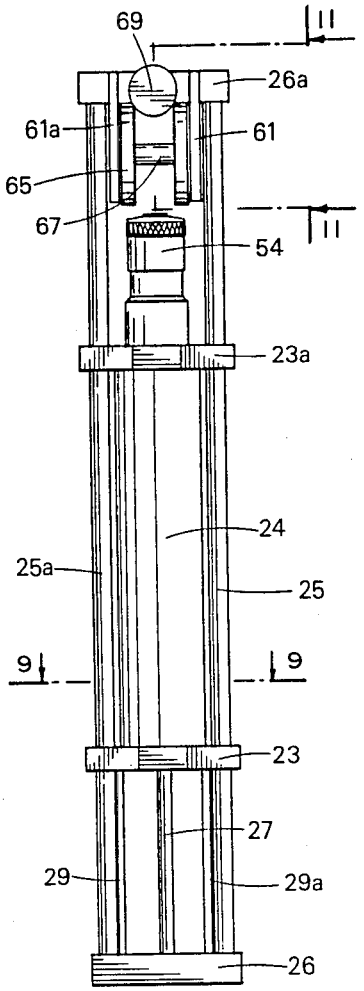
FIG. 8 is an elevation view of an embodiment of the hydraulic cylinder.
Figure 10:
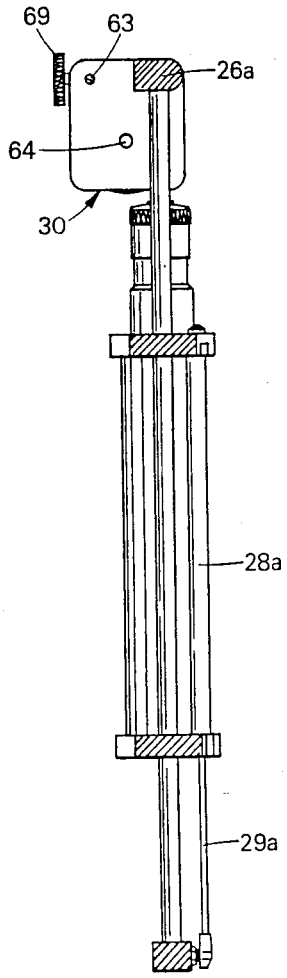
FIG. 10 is a sectional view taken along line 10—10 of FIG. 9.

The two crossbars 23,23*a* also block the body of two gas dampers 28,28*a* (FIGS. 1, 8 and 9) whose sliding rods 29,29*a* fastened to lower bar 26 are capable of returning the hydraulic cylinder piston 39 to the position shown in FIG. 3.

Figure 11:
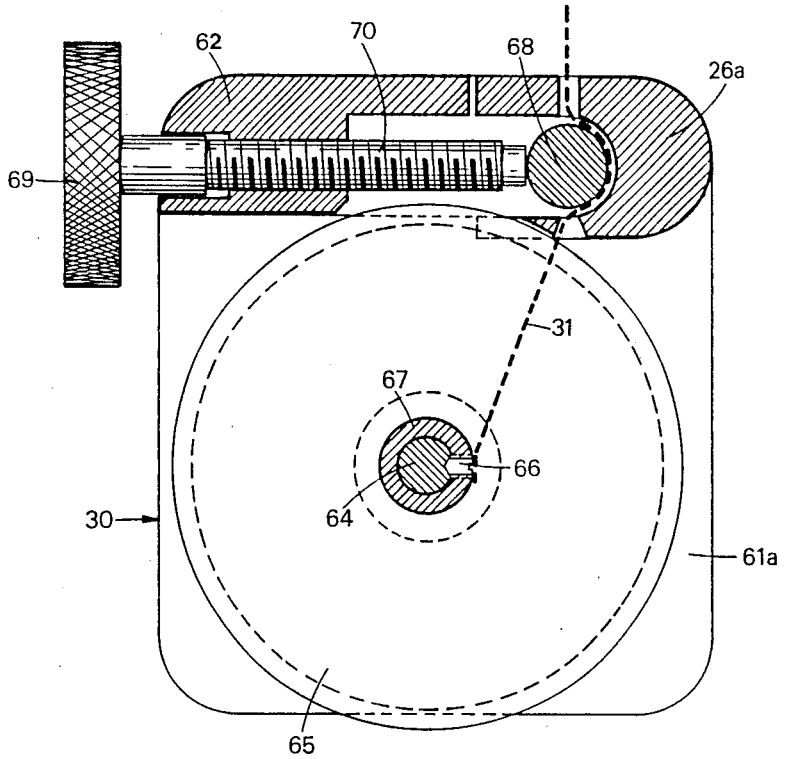
FIG. 11 is a sectional view taken along line 11—11 of FIG. 8.

Midway along bar 26*a* is attached a case 30 shown in FIG. 11 and comprising a mechanism for winding and unwinding strap 31 which can be blocked at the desired length. The case mechanism includes return springs.

Strap 31 is guided by pulley 32 mounted in free rotation at the extremity of element 5*a* and by rollers 33,33*a*, 33*b* and 33*c*.

The strap 31 is fastened to the middle of an exercise member, such as to the lever arm 21 actuated by the user.

Obviously, the strap 31 could be connected to any other accessories, such as the exercise members 16 and 20, that would be actuated by another part of the body of the user.

The pivoting of lever arm 21 about its axis 34 raises bar 26*a* connected to the entire translation system and also raises piston rod 27. The rising of the piston rod raises piston 39 of the cylinder (FIG. 3), which encounters resistance requiring exertion on the part of the user.

Piston 39 returns effortlessly under the action of gas dampers 28,28*a* as has been described above.

In FIGS. 3 to 7, there is shown an embodiment of the hydraulic cylinder which comprises a cylindrical body 35 within which is fixed on the bottom 35*a* one of the extremities of sleeve 36, thus forming a double-walled cylinder.

Fixed at one end of the body 35 by a threaded part 37*a* is a flange 37 which is extended by cylindrical part 37*b* delimiting interiorly a cylindrical space 38.

Inside the sleeve 36 is slidably mounted piston 39 provided with a sealing joint and having ducts 40 opening onto the two faces of the piston, the ducts being closable on one face by valve 41 slidably mounted on extension 27*a* of piston rod 27. valve 41 is subjected to the action of springs 42 abutting the stop 42*a* integral with extension 27*a* of the piston rod.

The valve is biased to the closed position to close the openings in ducts 40 under the action of springs 42.

Piston 39 is secured to rod 27 crossing bottom 35*a* of the body by packing rings 43, rod 27 being connected exteriorly to actuating means.

Between the body 35 and sleeve 36 is an annular space 44 communicating with the interior of sleeve 36 by ports 45 provided at one extremity of sleeve 36 and by two ports 46 at the other extremity.

Flow ports 46 (FIG. 3) are in the form of longitudinally extending slots of constant width provided in seat 47 sealingly connected to sleeve 36. Seat 47 has a bore 47*a* in which is slidably mounted a rod 48 for closing slots 46.

The ports 46 are connected to the annular space 44 by ports 49 provided in flange 37.

The sealing rod 48 is fixedly connected to one extremity of rod 50 crossing cylindrical space 38 and having threaded part 50*a* engaged in a tapped hole of cylindrical part 37*b* of flange 37. At the opposite extremity of rod 48 is attached by screw 53 a control knob 54 for adjusting the position of rod 48 by displacing the threaded part of rod 50, knob 54 forming the mobile part of a vernier moving opposite the graduated stationary part 51 of the vernier.

Inside the cylindrical space 38 is mounted for free sliding movement along rod 50 a piston 55 provided with a sealing joint 56. Piston 50 which is subjected on one side to the pressure of the hydraulic fluid and on the other side to the action of spring 57 is intended to offset variations in fluid volume in the body as a function of the displacement of piston rod 27 in the body.

At the opposite extremity of sealing rod 48, the bottom 35*a* of body 35 is provided with ports 58 normally closed by plugs 59 and intended for filling the cylinder with hydraulic fluid.

The cylinder is operated as follows:

Rod 48 being adjustable to a position determined by vernier knob 54, this provides a determined height for slots 46 which are uncovered by sealing rod 48 and produce a flow section for a determined fluid flow.

As a non-restrictive example, a resistance per revolution was defined proportional to the effort supplied at a same speed, i.e., 10 kg, corresponding to a predetermined width of slot on a height of 1 mm coinciding with the 1 mm vernier pitch (X width of slot X 1 mm flow section). Each millimeter the vernier rises or descends (one revolution) corresponds to 10 kg of more or less effort to be supplied. As a non-restrictive example, the vernier circumference was defined so as to provide 200 divisions of 1 mm, which in practice gives 10 kg/200=50 g/mm.

In this example, zero effort up to 10 kg starts from the zero point in the same plane as the bottom of rod 48 and the top of the slot up to 1 mm below. The movement along the slot corresponds to a flow section from 0 g to 10 kg dividable by 200, the vernier divisions per revolution being transposable into opening height (section) of the slot.

By exerting a thrust on rod 27, piston 39 moves in the direction of arrow F with the valve 41 moving into position to close piston ducts 40 under the action of the fluid.

Upon the displacement of piston 39, the fluid is forced back through ports 46 and ports 49 in a direction towards annular space 44 and returns into sleeve 36 through ports 45, ending up under piston 39 during its displacement in the direction of arrow F.

Since the rod 48 closes ports 46 more or less, the fluid flowing through these ports encounters more or less resistance opposing displacement of the piston and of rod 27 so that rod 27 must be subjected to greater or lesser force adjusted by control knob 54 acting on sealing rod 48.

Once the piston has completed its stroke, it can be driven in the opposite direction of arrow F so as to return to its starting position, as shown in FIG. 3. During this stroke, valve 41 which is free opens under the action of the fluid against springs 40, allowing the fluid to flow through ducts 40, in such a manner that there is no resistance to the return of the piston, which can therefore be returned automatically by an elastic member.

Figure 9:
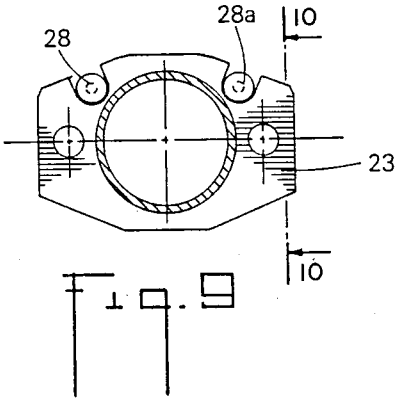
FIG. 9 is a sectional view taken along line 9—9 of FIG. 8.

In FIG. 11, there is shown an embodiment of case 30 which serves to wind or unwind strap 31 and comprises two cheeks 61,61*a* (FIG. 8) fixed to bar 26*a* and to part 62 extending from bar 26*a* and fastened by two lateral screws, one of which, 63, is represented in FIG. 9. These cheeks are crossed by a pivot pin 64 about which pulley 65 pivots. This pulley is provided on either side thereof with a channel notch for receiving a return spring which has a number of spirals determined by the length of strap 31. This strap is fastened by means of screw 66 and winds around shank 67 of pulley 65.

Movable roller 68 frees or blocks strap 31, as required, by means of control knob 69 comprising threaded rod 70. The return springs are intended to keep the strap taut and to wind it according to the desired length.

As a non-restrictive example, the mechanism can be activated simply by pulling strap 31 loosened in order to position it in the notch of pulley 32 and either hook its extremity directly to inner central clamp 60 of lever arm 21 or pass the strap under roller 33*a* and then attach its extremity to central clamp 60. Strap 31 being held taut by the return springs of case 30, lever arm 21 is simply positioned at the desired height and angle and the strap blocked by means of control knob 69.

These various positions permit the exertion of downward effort in the first instance or upward effort in the second instance.

Figure 12:
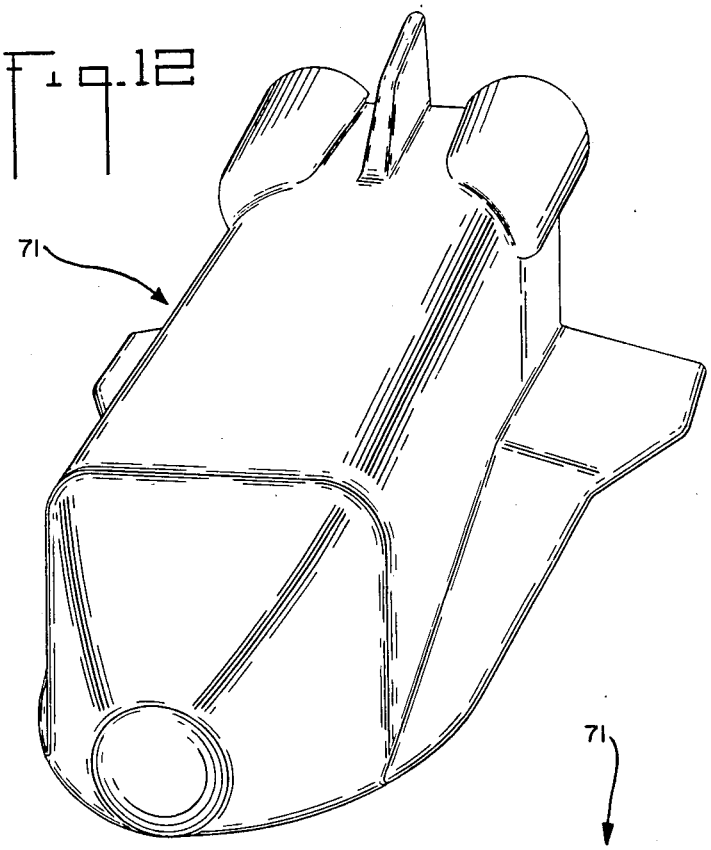
FIGS. 12 and 13 are front and rear perspective views of one type of container for the collapsed exercise machine.
Figure 13:
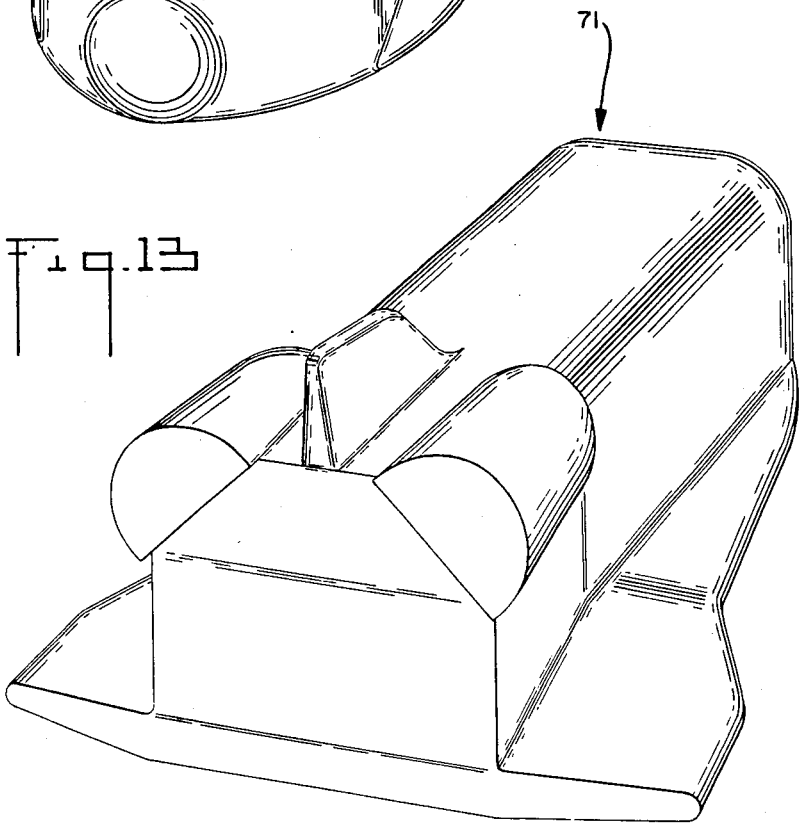

FIGS. 12 and 13 are front and rear perspective views of a type of container 71 designed specially to house the new exercise machine based on the particular features of the machine.

Figure 14:
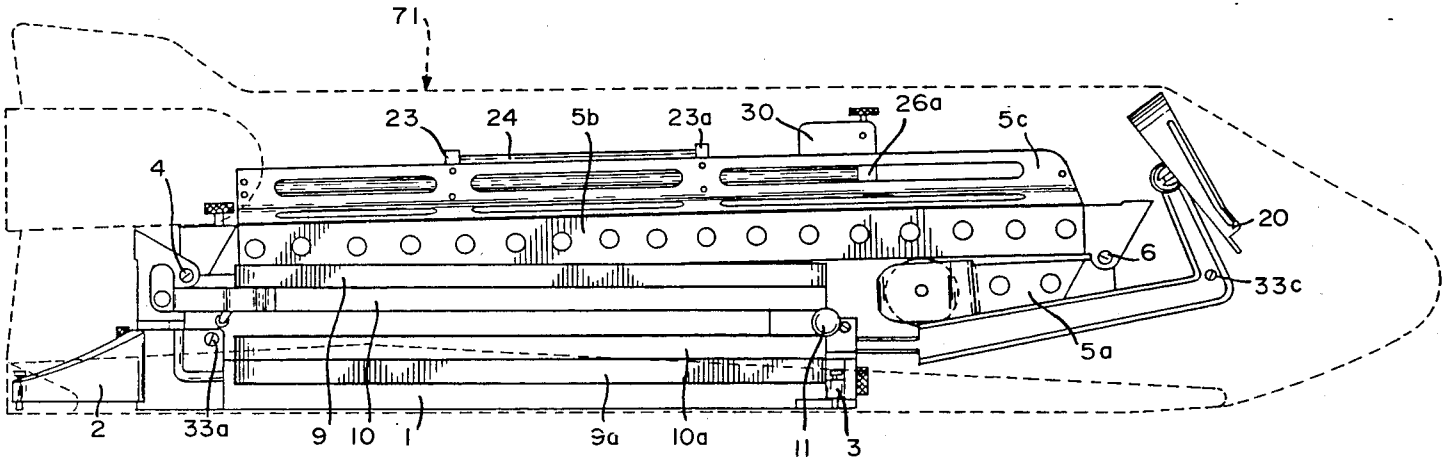
FIG. 14 is a side view showing the collapsed exercise machine in its container.

FIG. 14 illustrates the exercise machine collapsed in its container 71.

The choice of materials, e.g., aluminum alloys and industrial plastics, and the aerodynamic profile of container 71 permit convenient carriage of the machine on automobile roof racks for trips, weekends and other occasions.

We claim:

1. An exercise machine adapted to be actuated by a user, comprising a frame including a base, legs mounted on said base and a column connected to and extending upwardly from said base, said column including a housing and a variable load-regulating hydraulic cylinder fixedly mounted in said housing, said cylinder including a piston slidably received within said cylinder and a piston rod attached to said piston and extending outwardly from said cylinder; at least one bench mounted to said frame so as to accommodate the user; at least one exercise member pivotally mounted to said frame such that its angle of inclination relative to the vertical is variable, whereby the user can pivot said at least one exercise member from a rest position in which said at least one exercise member forms a predetermined angle of inclination with respect to the vertical; and translation means movable relative to said housing for interconnecting said at least one exercise member to said piston rod such that the pivotal movement of said at least one exercise member from said rest position causes the conjoint movement of said piston rod into said cylinder, whereby a force exerted on said at least one exercise member by the user during its pivotal movement is counteracted by a force exerted on said piston from within said cylinder, said translation means including a strap connected to said at least one exercise member and strap adjustment means for varying the length of said strap and for releasably locking said strap at a predetermined length to thereby adjust said angle of inclination of said at least one exercise member when at said rest position.

2. An exercise machine according to claim 1, wherein said column is pivotally attached to said base, said column including a plurality of foldable elements, whereby said exercise machine may be collapsed to facilitate its transportability.

3. An exercise machine according to claim 1, wherein said machine is collapsible into a wedge-shaped configuration, whereby said machine can fit into an aerodynamically-shaped container adapted to be mounted on an automobile roof.

4. An exercise machine according to claim 1, wherein said hydraulic cylinder includes a double-walled cylindrical body having a cylindrical inner sleeve within which moves said piston, said sleeve having ports located at opposite ends thereof for connecting an internal space within said sleeve to an annular space delimited between said sleeve and said cylindrical body, one of said ports being located remote from said piston rod and being provided with a sealing member for controlling the flow of hydraulic fluid into said annular space through said one port, said one port including at least one longitudinally extending slot formed in a seat attached to said sleeve, said seat having a bore which slidably receives said sealing member, said sealing member being formed integrally with a rod which is threadedly engaged in a hole provided in said cylindrical body, said rod having at an end opposite said sealing member a control knob defining a vernier which is movable relative to a graduated stationary portion of said cylindrical body, and wherein said piston includes at least one duct extending through said piston from one face thereof to an opposite face thereof and valve means for sealing said at least one duct during the movement of said piston rod into said cylinder.

5. An exercise machine according to claim 4, wherein said valve means includes a valve member which is urged by spring means against said piston.

6. An exercise machine according to claim 4, wherein each of said slots has a constant width.

7. An exercise machine according to claim 4, wherein each of said slots has a height proportional to a selected number of vernier graduations.

8. An exercise machine according to claim 1, wherein said translation mechanism includes a first bar connected to said piston rod and slidably mounted in said column, a second bar slidably mounted in said column above said first bar, and means for connecting said first bar to said second bar such that said second bar moves conjointly with said first bar.

9. An exercise machine according to claim 8, wherein said strap adjustment means includes a pulley mounted on said second bar of said translation means such that said pulley is rotatable, said pulley being connected to said strap such that said strap can be wound onto or unwound from said pulley, and clamping means for clamping said strap to thereby prevent said strap from being wound onto or unwound from said pulley.

10. An exercise machine according to claim 9, wherein said clamping means includes a stationary clamp member and a movable clamp member, said movable clamp member and said stationary clamp member being arranged such that said strap passes therebetween.

11. An exercise machine according to claim 10, wherein said clamping means further includes moving means for moving said movable clamp member towards said stationary clamp member to thereby lock said strap therebetween.

12. An exercise machine according to claim 11, wherein said moving means includes a control knob having an externally threaded rod.

13. An exercise machine according to claim 1, wherein said translation means includes elastic members which urge said piston rod outwardly of said cylinder, whereby said piston rod is automatically returned to a rest position when the user releases said exercise member.

14. An exercise machine according to claim 1, wherein said column includes a plurality of U-shaped channels, each of said channels including a multiplicity of spaced-apart apertures sized and shaped so as to receive pin means for pinning said exercise member to said column, the location and number of said apertures being selected so as to permit said exercise member to be arranged at a plurality of different heights relative to said column.

15. An exercise machine according to claim 1, further comprising a plurality of exercise members arranged at different locations relative to said frame, said strap having a length which is sufficient so as to permit said strap to be selectively attached to each of said exercise members.

* * * * *